US008708334B2

(12) United States Patent
Tokisawa et al.

(10) Patent No.: US 8,708,334 B2
(45) Date of Patent: Apr. 29, 2014

(54) RECORDING MEDIUM SUPPLY DEVICE AND RECORDING APPARATUS

(71) Applicant: Canon Kabushiki Kaisha, Tokyo (JP)

(72) Inventors: Toshiaki Tokisawa, Yokohama (JP); Tetsu Hamano, Tokyo (JP); Kenji Kawazoe, Yokohama (JP); Kazuyuki Morinaga, Machida (JP); Masaya Shimmachi, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/837,202

(22) Filed: Mar. 15, 2013

(65) Prior Publication Data

US 2013/0207337 A1 Aug. 15, 2013

Related U.S. Application Data

(62) Division of application No. 12/961,845, filed on Dec. 7, 2010, now Pat. No. 8,444,139.

(30) Foreign Application Priority Data

Dec. 16, 2009 (JP) ..... 2009-285160

(51) Int. Cl.
*B65H 3/34* (2006.01)

(52) U.S. Cl.
USPC ..... 271/167; 271/169

(58) Field of Classification Search
USPC ..... 271/126, 127, 160, 121, 122, 157, 167
See application file for complete search history.

(56) References Cited

U.S. PATENT DOCUMENTS

| | | | | | |
|---|---|---|---|---|---|
| 5,240,241 | A | * | 8/1993 | Kawazoe | 271/114 |
| 5,398,108 | A | * | 3/1995 | Morinaga et al. | 399/381 |
| 5,571,265 | A | * | 11/1996 | Yagi et al. | 271/119 |
| 5,632,477 | A | * | 5/1997 | Morinaga | 271/127 |
| 5,722,654 | A | * | 3/1998 | Sootome et al. | 271/119 |
| 5,816,723 | A | * | 10/1998 | Takahashi et al. | 400/624 |
| 5,823,524 | A | * | 10/1998 | Kawada | 271/124 |
| 5,886,729 | A | * | 3/1999 | Hiramatsu et al. | 347/264 |
| 6,113,093 | A | * | 9/2000 | Morinaga et al. | 271/162 |

(Continued)

FOREIGN PATENT DOCUMENTS

| | | | |
|---|---|---|---|
| JP | 7-69464 | A | 3/1995 |
| JP | 2003-321133 | A | 11/2003 |

*Primary Examiner* — Kaitlin Joerger
(74) *Attorney, Agent, or Firm* — Fitzpatrick, Cella, Harper & Scinto

(57) ABSTRACT

A recording medium supply device includes a cassette attachable to and detachable from a main body and capable of stacking recording medium thereon, a feeding roller which feeds the uppermost recording medium to the main body from a leading end of the recording medium, a regulating member which is arranged forward in the direction in which the cassette is removed from the main body as seen from the feeding roller, and a projection preventing member attached adjacent to the tip portion of the cassette facing the leading end of the recording medium. The position of the lower end of the regulating member is higher than the cassette attached to the main body, and lower than the lower end of the feeding roller, and the position of the upper end of the projection preventing member is higher than the position of the lower end of the regulating member.

21 Claims, 17 Drawing Sheets

(56) References Cited

U.S. PATENT DOCUMENTS

| | | | | |
|---|---|---|---|---|
| 6,422,772 | B1 * | 7/2002 | Fisher et al. | 400/629 |
| 6,485,015 | B2 * | 11/2002 | Yen et al. | 271/121 |
| 6,502,816 | B2 * | 1/2003 | Inoue et al. | 271/121 |
| 7,624,979 | B2 * | 12/2009 | Masutani | 271/167 |
| 7,828,285 | B2 * | 11/2010 | Chu et al. | 271/167 |
| 7,832,722 | B1 * | 11/2010 | Huang | 271/121 |
| 2006/0038339 | A1 | 2/2006 | Shimamura | |
| 2009/0273137 | A1 | 11/2009 | Chen et al. | |

* cited by examiner

RECORDING MEDIUM SUPPLY DEVICE AND RECORDING APPARATUS

This application is a divisional of U.S. patent application Ser. No. 12/961,845, filed Dec. 7, 2010 and allowed on Jan. 22, 2013.

BACKGROUND OF THE INVENTION

1. Field of the Invention

The present invention relates to a recording medium supply device including a cassette attachable to and detachable from a main body of a recording apparatus and capable of stacking a recording medium thereon, and a recording apparatus.

2. Description of the Related Art

Conventionally, among recording apparatuses represented by a printer or the like, there are recording apparatuses in which recording media (for example, recording papers) are stacked on a cassette which is attachable to and detachable from the main body of the apparatus, and a recording medium on the uppermost layer is conveyed to the main body of the apparatus by a conveying roller arranged above the cassette.

In the recording apparatuses in which recording media are stacked on the cassette which is attachable to and detachable from the main body of the apparatus as described above, if a recording medium during conveyance is left in the conveying roller when the cassette is removed (pulled out) from the main body of the apparatus, the recording medium may be jammed when the cassette is attached again. Thus, apparatuses which perform the operation of returning the recording medium into the cassette from the conveying roller when removal of the cassette has been detected are suggested (refer to Japanese Patent Application Laid-Open No. 2003-321133 and Japanese Patent Application Laid-Open No. H07-69464). According to these apparatuses, when the cassette is removed, the recording medium during conveyance is prevented from being left in the conveying roller.

Among the recording apparatuses in which recording media are stacked on the cassette which is attachable to and detachable from the main body of the apparatus as described above, there are recording apparatuses including a thick plate or a regulating member in order to make a recording medium reliably abut on the conveying roller. A pressure plate is attached to the bottom face of the cassette thereby pushing up the leading end of the recording medium to a position higher than the tip portion of the cassette. Meanwhile, the regulating member is arranged forward in the direction in which the cassette is removed from the main body of the apparatus as seen from the conveying roller, and depresses a portion of the leading end of the recording medium to a position lower than the lower end of the conveying roller. In such recording apparatuses, there is a case where a recording medium is left in the main body of the apparatus when the cassette is attached and detached (moved) in addition to the cases described in Japanese Patent Application Laid-Open No. 2003-321133 and Japanese Patent Application Laid-Open No. H07-69464. For example, a case is assumed where a portion of a recording medium projects out of the tip portion of the cassette due to the frictional force produced by the contact between the leading end of the recording medium on the uppermost layer and the lower end of the regulating member when the cassette is attached and detached. In this case, since the recording medium which has projected out drops, this recording medium is left in the main body of the apparatus.

SUMMARY OF THE INVENTION

The object of the invention is to provide a recording medium supply device capable of suppressing a recording medium projecting out of a cassette in a case where the position of the leading end of the recording medium becomes higher than the tip portion of the cassette when the cassette having recording media stacked thereon is attached and detached, and a recording apparatus.

In order to achieve the above object, a recording medium supply device according to the invention is a recording medium supply device which supplies the recording medium to a recording apparatus including a main body which performs recording on a recording medium. The recording medium supply device includes a cassette attachable to and detachable from the main body and capable of stacking the recording medium thereon; a conveying roller which is arranged above the cassette attached to the main body and conveys a recording medium on the uppermost layer stacked on the cassette to the main body from the leading end of the recording medium; a regulating member which is arranged forward in the direction in which the cassette is removed from the main body as seen from the conveying roller; and a projection preventing member attached adjacent to the tip portion of the cassette facing the leading end of the recording medium. The position of the lower end of the regulating member is higher than the cassette attached to the main body, and lower than the lower end of the conveying roller, and the position of the upper end of the projection preventing member is higher than the position of the lower end of the regulating member.

Additionally, in order to achieve the above object, another recording medium supply device according to the invention is a recording medium supply device which supplies the recording medium to a recording apparatus including a main body which performs recording on a recording medium. The recording medium supply device includes a cassette attachable to and detachable from the main body and capable of stacking the recording medium thereon; a conveying roller which is arranged above the cassette attached to the main body and conveys a recording medium on the uppermost layer stacked on the cassette to the main body from the leading end of the recording medium; a regulating member which is arranged forward in the direction in which the cassette is removed from the main body as seen from the conveying roller; and a projection preventing member arranged between the conveying roller and the regulating member above the cassette. The position of the lower end of the regulating member is higher than the cassette attached to the main body, and lower than the lower end of the conveying roller, and the position of the lower end of the projection preventing member is lower than the position of the lower end of the regulating member.

Additionally, in order to achieve the above object, a recording apparatus according to the invention is a recording apparatus including a main body which performs recording on a recording medium, and a recording medium supply device which supplies the recording medium to the main body. The recording medium supply device includes a cassette attachable to and detachable from the main body and capable of stacking the recording medium thereon; a conveying roller which is arranged above the cassette attached to the main body and conveys a recording medium on the uppermost layer stacked on the cassette to the main body from a leading end of the recording medium; a regulating member which is arranged forward in the direction in which the cassette is removed from the main body as seen from the conveying roller; and a projection preventing member attached adjacent to the tip portion of the cassette facing the leading end of the recording medium. The position of the lower end of the regulating member is higher than the cassette attached to the main body, and lower than the lower end of the conveying roller, and the position of the upper end of the projection preventing member is higher than the position of the lower end of the regulating member.

Additionally, in order to achieve the above object, another recording apparatus according to the invention is a recording apparatus including a main body which performs recording on a recording medium, and a recording medium supply device which supplies the recording medium to the main body. The recording medium supply device includes a cassette attachable to and detachable from the main body and capable of stacking the recording medium thereon; a conveying roller which is arranged above the cassette attached to the main body and conveys a recording medium on the uppermost layer stacked on the cassette to the main body from the leading end of the recording medium; a regulating member which is arranged forward in the direction in which the cassette is removed from the main body as seen from the conveying roller; and a projection preventing member arranged between the conveying roller and the regulating member above the cassette. The position of the lower end of the regulating member is higher than the cassette attached to the main body, and lower than the lower end of the conveying roller, and the position of the lower end of the projection preventing member is lower than the position of the lower end of the regulating member.

According to the invention, in a case where the projection preventing member is attached adjacent to the tip portion of the cassette, the upper end of the projection preventing member is located at a position higher than the lower end of the regulating member. Therefore, even if the leading end of a recording medium is pushed up to a position higher than the tip portion of the cassette when the cassette is attached and detached, and a portion of the leading end of the recording medium on the uppermost layer comes into contact with the lower end of the regulating member, projection of the recording medium from the cassette is suppressed by the projection preventing member. Additionally, in a case where the projection preventing member is arranged between the conveying roller and the regulating member above the cassette, the lower end of the projection preventing member is located at a position lower than the lower end of the regulating member. Therefore, even in this case, even if the leading end of a recording medium is pushed up to a position higher than the tip portion of the cassette when the cassette is attached and detached, and a portion of the leading end of the recording medium on the uppermost layer comes into contact with the lower end of the regulating member, projection of the recording medium from the cassette is suppressed by the projection preventing member.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

First Embodiment

Figure 1:
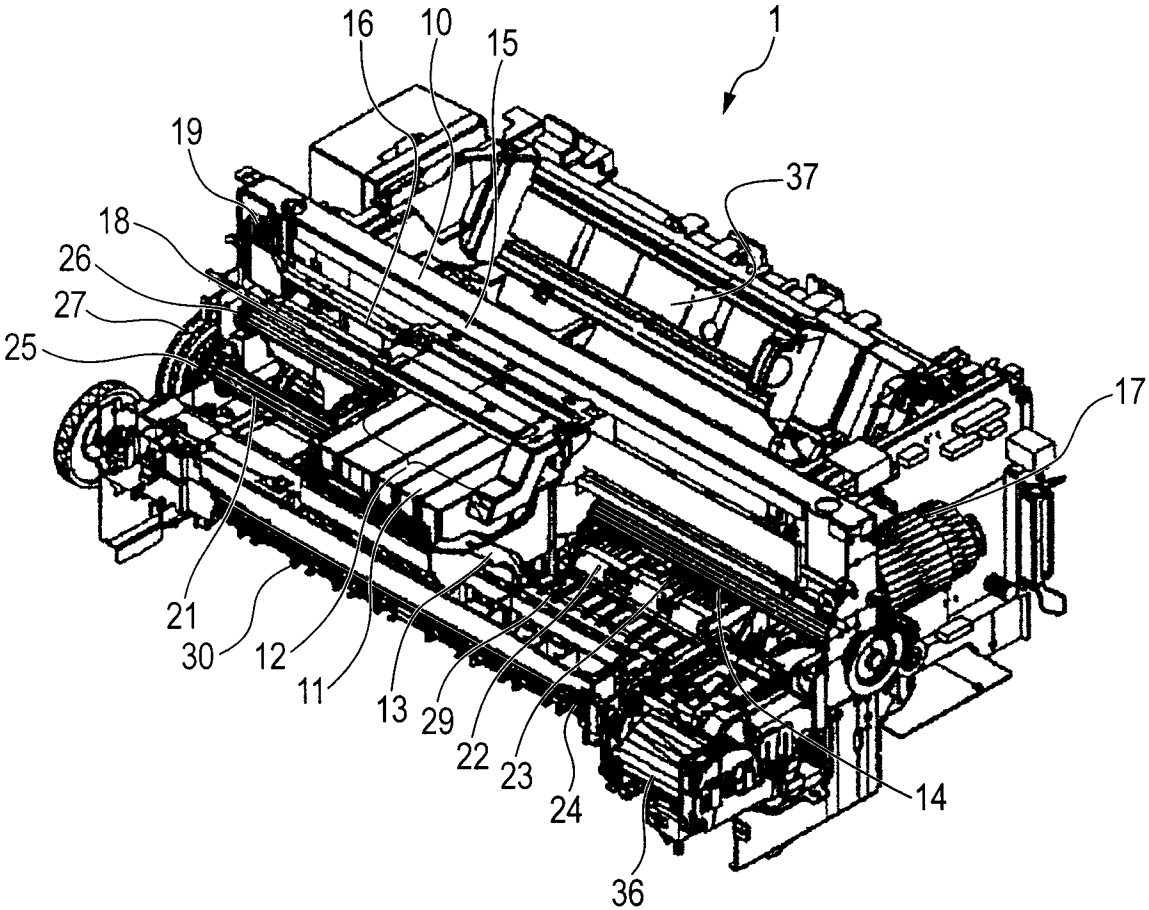
FIG. 1 is a perspective view illustrating the construction of one embodiment of a main body which constitutes the recording apparatus of the invention.

FIG. 1 is a perspective view illustrating the construction of one embodiment of a main body which constitutes the recording apparatus of the invention.

As illustrated in FIG. 1, in the main body 1 of the recording apparatus of the present embodiment, a chassis 10 supports some of constituent elements of the main body 1. A recording head 11 supported by the chassis discharges ink to perform recording. The ink to be discharged by the recording head 11 is stored in an ink tank 12. The ink tank 12 is held by a carriage 13, and the carriage 13 scans in a direction (main scanning direction) which intersects a conveying direction (sub-scanning direction) of a sheet-like recording medium (recording paper in the present embodiment). The carriage 13 is supported by a guide rail 15 parallel to a guide shaft 14. Additionally, the carriage 13 is driven by a carriage belt 16, and the carriage belt 16 is driven by a carriage motor via a pulley. The position of the carriage 13 is detected by a cord strip 18. The carriage belt 16 is stretched over an idle pulley 19 so as to face the pulley of the carriage motor 17.

Moreover, in the main body 1 of the recording apparatus, a sheet feeding roller 21 conveys a recording medium, and a pinch roller 22 is pressed against and driven by the sheet feeding roller 21. The pinch roller 22 is rotatably held by a pinch roller holder 23, and the pinch roller 22 is brought into pressure contact with the sheet feeding roller 21 by a pinch roller spring 24. A sheet feeding roller pulley 25 is fixed to one end of the sheet feeding roller 21. The sheet feeding roller 21 is driven by an LF motor 26. At this time, a cord wheel 27 detects the rotational angle of the sheet feeding roller 21. The recording medium is supported by a platen 29 which is arranged to face the recording head 11, and is conveyed by a sheet ejection roller 30 which cooperates with the sheet feeding roller 21.

Moreover, in the main body 1 of the recording apparatus, a maintenance unit 36 is used when ink is sucked from nozzles of the recording head 11 to prevent clogging. Additionally, the maintenance unit 36 is used even when ink is sucked from the nozzles of the recording head 11 and air bubbles within flow passages of the recording head 11 are removed when the ink tank 12 is replaced. Additionally, the main body 1 of the recording apparatus has recording media stacked thereon, and has an ASF (Automatic Sheet Feeder) 37 which supplies recording media one by one to the inside of the main body during a recording operation. In addition, in addition to the ASF 37, the recording apparatus of the present embodiment includes a recording medium supply device attached to a lower portion of the main body 1 as a constituent element which supplies recording media. Therefore, when the recording apparatus of the present embodiment performs recording on different kinds of recording media, it is possible to save the time and effort which are required to replace the recording media. Hereinafter, the construction of the recording medium supply device 100 of the present embodiment will be described referring to FIGS. 2 and 3.

Figure 2:
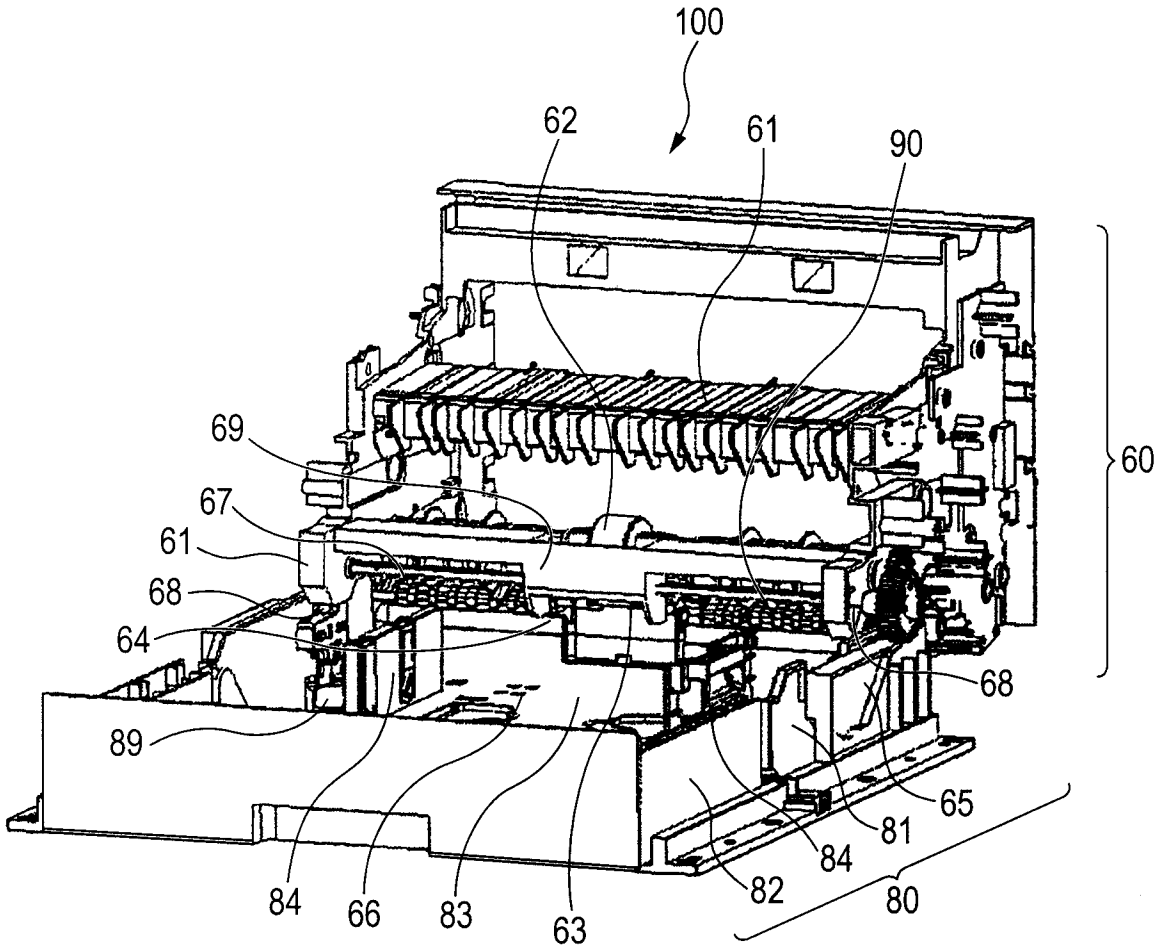
FIG. 2 is a perspective view illustrating one embodiment of a recording medium supply device which constitutes the recording apparatus of the invention.
Figure 3:
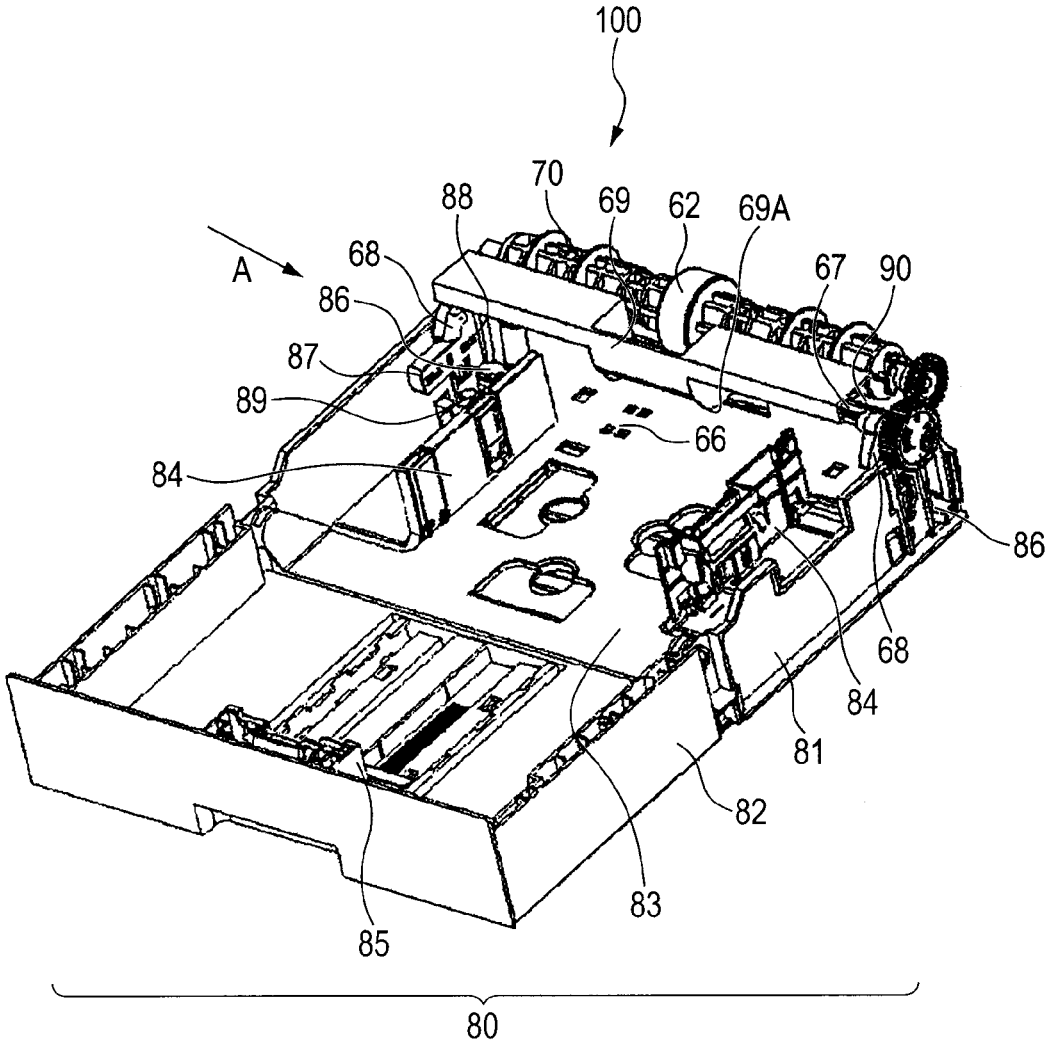
FIG. 3 is a perspective view illustrating chief parts of the recording medium supply device illustrated in FIG. 2.

FIG. 2 is a perspective view illustrating one embodiment of the recording medium supply device which constitutes the recording apparatus of the invention. Additionally, FIG. 3 is a perspective view illustrating chief parts of the recording medium supply device illustrated in FIG. 2.

As illustrated in FIG. 2, the recording medium supply device 100 has a PFU (Paper Feeding Unit) 60 which supplies recording media one by one to the main body 1 in a substantially horizontal direction during a recording operation, and a cassette 80 which is attachable to and detachable from the PFU 60 and is capable of stacking recording media. The PFU 60 includes a rotating shaft 70 (refer to FIG. 3) which is supported by a support member 61 and extends in a direction perpendicular to the conveying direction of a recording medium. A feeding roller 62 which feeds a recording medium on the uppermost layer stacked on the cassette 80 from the leading end of the recording medium is rotatably attached to the rotating shaft 70. A separation roller 63 which separates a plurality of recording media one by one, and a claw portion 64 for returning the leading end of the recording medium which has preceded a nip portion between the feeding roller 62 and the separation roller 63 during conveyance to a predetermined position are attached in the vicinity of the feeding roller 62.

A regulating member 69 is arranged in the state of being supported by the support member 61 forward in the direction in which the recording medium is removed from the main body 1 as seen from the feeding roller 62. The regulating member 69 performs regulation so that the height of the leading end of the recording medium does not become higher than the lower end of the feeding roller 62 when the cassette 80 is mounted. Therefore, the position of the lower end 69A (refer to FIG. 3) of the regulating member 69 is higher than the cassette 80 attached to the main body 1 and is lower than the lower end of the feeding roller 62.

A guide member 65 which guides the attachment and detachment of the cassette 80 to/from the main body 1 is provided below the feeding roller 62 and the regulating member 69. Additionally, a shaft 67 which extends in the direction perpendicular to the conveying direction of a recording medium is arranged in the state of being supported by the support member 61 between the feeding roller 62 and the regulating member 69. Sheet feeding cams 68 are attached to both ends of the shaft 67.

The cassette 80 is provided with an inner cassette 81 and an outer cassette 82 which constitute an outer frame of the cassette 80. Additionally, the bottom of the cassette 80 is provided with a pressure plate 83 which pushes up the leading ends of stacked recording media toward the feeding roller 62, and a pressure plate spring 66 which is attached to the lower end of the pressure plate and biases the pressure plate 83 toward the feeding roller 62.

Cassette side guides 84 capable of being fixed to the horizontal size of arbitrary recording media are provided inside the inner cassette 81. Additionally, a cassette end guide 85 (refer to FIG. 3) capable of being fixed to the vertical size of arbitrary recording media is provided inside the outer cassette 82. A holder 87 which depresses the pressure plate 83 is attached to the cassette side guides 84. In the holder 87, holder claw portions 88 which engage with pressure plate claw portions 86 are provided at positions where the holder claw portions face the pressure plate claw portions 86 provided at both ends of the pressure plate 83. Additionally, the lower end of the holder 87 is provided with a holder spring 89 which biases the holder 87 upward. A projection preventing member (movement regulating member) 90, which prevents a recording medium from projecting out of the cassette 80 when the cassette 80 is attached and detached, is provided at a position adjacent to the tip portion of the inner cassette 81 so as to be capable of ascending and descending.

In addition, when the pressure plate 83 is depressed to the lowest end in a state where the cassette is removed from the main body 1, the cassette 80 is provided with a locking mechanism (not illustrated) which locks the pressure plate 83 at the depressed position. Also, when the cassette 80 is attached to the main body 1 in a state where the pressure plate 83 is locked by the locking mechanism, the locking of the pressure plate 83 is released partway along by a cassette pressure plate releasing portion (not illustrated) formed at the guide member 65. Similarly, when the cassette 80 is pulled out, the pressure plate 83 is locked partway along.

Figure 4A:
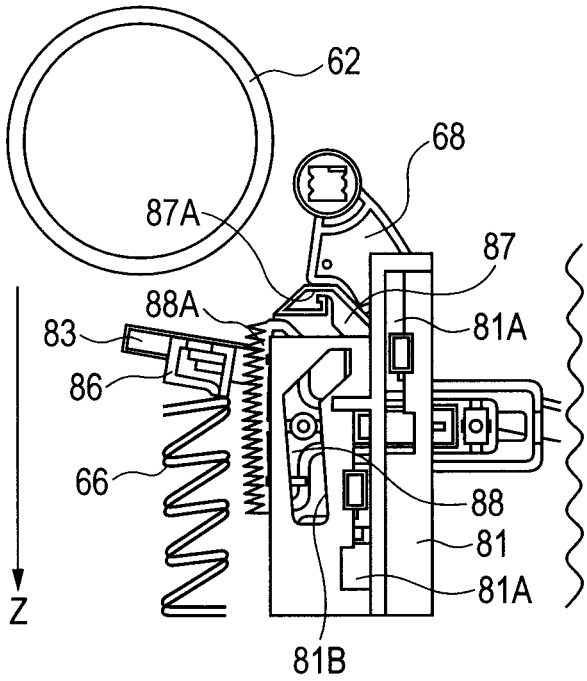
FIGS. 4A, 4B, 4C and 4D are cross-sectional views illustrating a series of operations through which the recording medium supply device of the first embodiment conveys a recording medium.
Figure 4B:
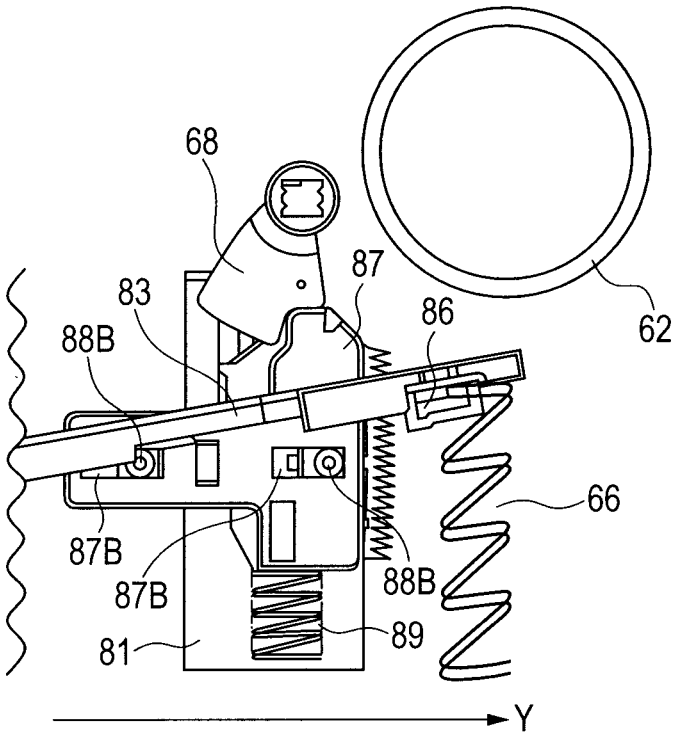
Figure 4C:
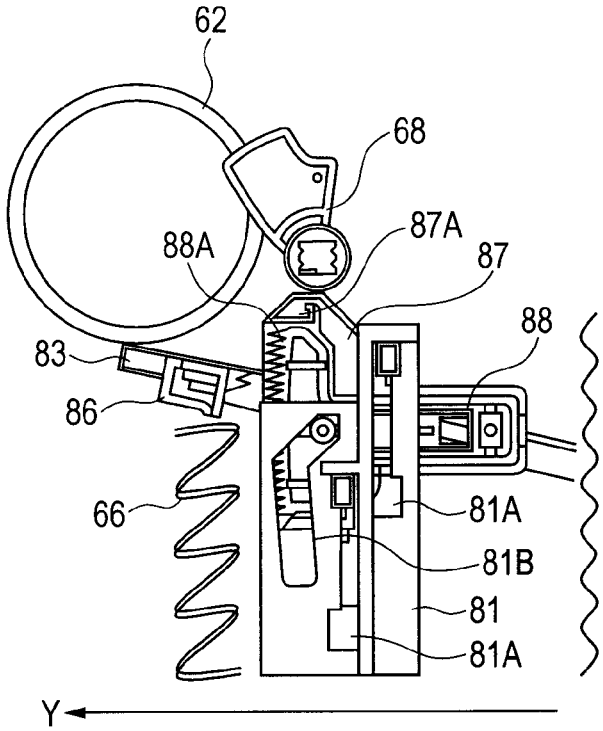
Figure 4D:
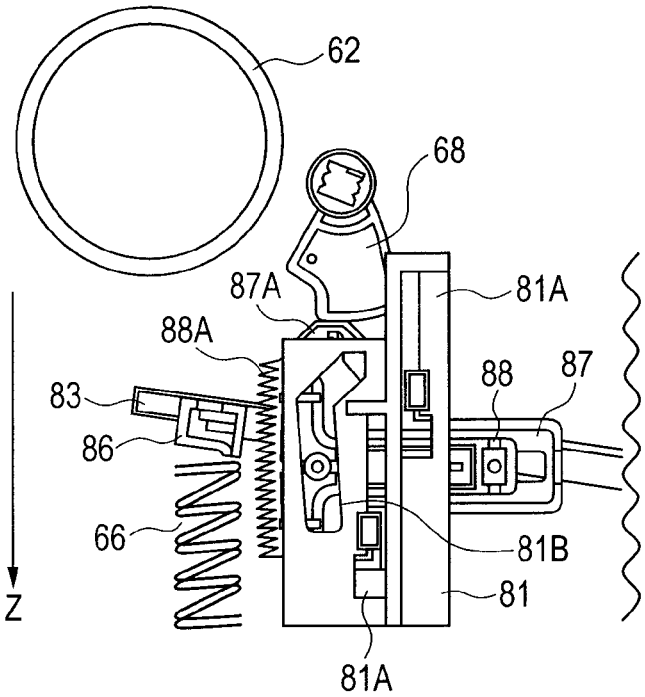

Next, a series of operations through which the recording medium supply device of the present embodiment conveys a recording medium will be described with reference to FIGS. 4A to 4D. In addition, FIGS. 4A to 4D illustrate a case where the stacked amount of recording media within the cassette 80 is small. Additionally, FIGS. 4A, 4C, and 4D are cross-sectional views when the recording medium supply device 100 illustrated in FIG. 3 is seen from an A direction (lateral direction) (refer to FIG. 3), and FIG. 4B is a cross-sectional view when FIG. 4A is seen from its opposite side.

As illustrated in FIG. 4A, in the cassette 80, the holder 87 is slidably attached to a groove portion 81A of the inner cassette 81 which extends in the vertical direction. An upper portion of the holder 87 is formed with the upper end protrusion 87A, and the upper end protrusion 87A comes into sliding contact with the outer peripheral surface of the sheet feeding cam 68 as the holder 87 is biased upward with the holder spring 89. Therefore, as the sheet feeding cam 68 rotates, the holder 87 is allowed to descend in the Z direction (refer to FIG. 4A) which is the direction in which the holder is depressed along the outer peripheral surface of the sheet feeding cam 68.

Additionally, as illustrated in FIG. 4B, a long hole 87B which extends in the horizontal direction is provided inside the holder 87. By coupling the long hole 87B with the guide pin 88B of the holder claw portion 88, the holder claw portion 88 becomes movable in the Y direction (refer to FIG. 4B) which is a first direction in which the holder claw portion approaches the tip portion of the cassette 80. The holder claw portion 88 which has moved in the Y direction descends in the Z direction along a groove portion 81B (refer to FIG. 4A) which is formed in the inner cassette 81 and extends in the vertical direction.

FIGS. 4A and 4B illustrate the stand by state of a conveying operation. In this state, the holder 87 descends in the Z direction by the sheet feeding cam 68. The holder claw portion 88 moves in the Y direction with the descent of the holder 87, and subsequently, the holder claw portion 88 descends in the Z direction in a state where the holder claw portion engages with the pressure plate claw portion 86. Since the pressure plate 83 is depressed with the descent of the pressure plate claw portion 86, the recording media (not illustrated) stacked on the pressure plate 83 are separated from the feeding roller 62.

FIG. 4C illustrates a state during the conveying operation. When the sheet feeding cam 68 rotates on the basis of a sheet feeding signal indicating the start of conveyance, the sheet feeding cam 68 is brought into non-contact with the holder 87. Then, since the holder 87 is biased upward by the holder spring 89, the holder 87 ascends. With the ascent of the holder 87, the holder claw portion 88 ascends along the groove portion 81B of the inner cassette 80. Subsequently, the holder claw portion 88 moves in a second direction (direction opposite to the Y direction) away from the tip portion of the cassette 80 along the long hole 87B. With the movement of the holder claw portion 88, the pressure plate claw portion 86 and the holder claw portion 88 are disengaged from each other, and the depressed state of the pressure plate 83 is released. Since the pressure plate 83 is biased upward by the pressure plate spring 66, the pressure plate 83 ascends when the depressed state is released. As a result, a portion of a leading end of the uppermost recording medium (not illustrated) stacked on the pressure plate 83 is brought into pressure contact with the feeding roller 62. As the feeding roller 62 rotates in this state, the recording medium is conveyed to the main body 1.

FIG. 4D illustrates a state where the feeding roller 62 is separated from the pressure plate 83. When the sheet feeding cam 68 rotates further after the conveying operation, the sheet feeding cam 68 comes into sliding contact with the holder 87 again. This causes the holder 87 to descend in the Z direction. With the descent of the holder 87, the holder claw portion 88 moves in the Y direction and engages with the pressure plate claw portion 86. Therefore, with the descent of the holder claw portion 88, the pressure plate claw portion 86 also descends and the pressure plate 83 is depressed. By making the holder 87 descend due to the sheet feeding cam 68 in this way, the pressure plate claw portion 86 is depressed. Thereby, the pressure plate 83 is depressed in a direction (Z direction) opposite to the direction of the resilient force of the pressure plate spring 66, and a gap of a predetermined distance is left between the recording medium on the uppermost layer stacked on the pressure plate 83, and the feeding roller 62. Thereafter, when the sheet feeding cam rotates further, the state illustrated in FIG. 4A is brought about.

In the ascent/descent operation of the pressure plate 83 as described above, even if the stacked amount (stacked height) of recording media stacked on the cassette becomes different, the engagement position of the plurality of engaging portions 88A provided at the tip portion of the holder claw portion 88, and the pressure plate claw portion 86 changes. It is thereby possible to move the pressure plate 83 in the direction (the Z direction) in which the pressure plate is separated from the feeding roller 62 with almost the same timing from the start of rotation of the feeding roller 62, and to leave a gap of a predetermined distance between the recording medium on the uppermost layer, and the feeding roller 62.

Next, the operation of detaching and attaching the cassette 80 from/to the main body 1 will be described with reference to FIGS. 5 and 6A to 6E.

Figure 5:
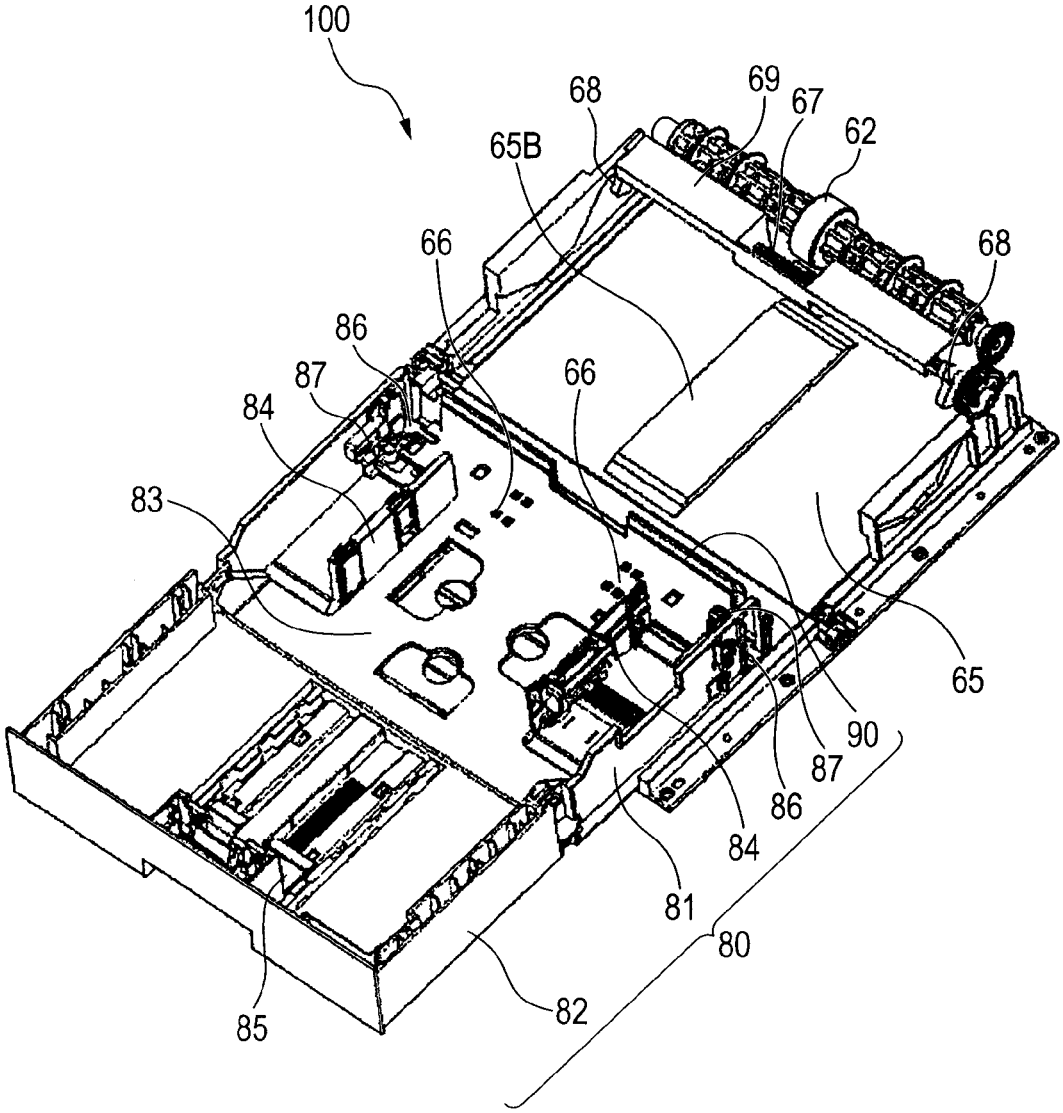
FIG. 5 is a perspective view illustrating a state where a cassette is being attached to and detached from the main body, in the recording medium supply device of the first embodiment.

FIG. 5 is a perspective view illustrating a state where the cassette 80 is being attached to and detached from the main body 1, in the recording medium supply device of the present embodiment. Additionally, FIGS. 6A to 6E are cross-sectional views illustrating a series of operations of chief parts when the cassette is attached to and detached from the main body, in the recording medium supply device of the present embodiment. Similarly to FIGS. 4A to 4D, the cross-sectional views when the recording medium supply device 100 illustrated in FIG. 3 is seen from the A direction (refer to FIG. 3) are illustrated in FIGS. 6A to 6E.

First, the operation of mounting the cassette 80 on the mounting position of the main body 1 will be described.

Figure 6A:
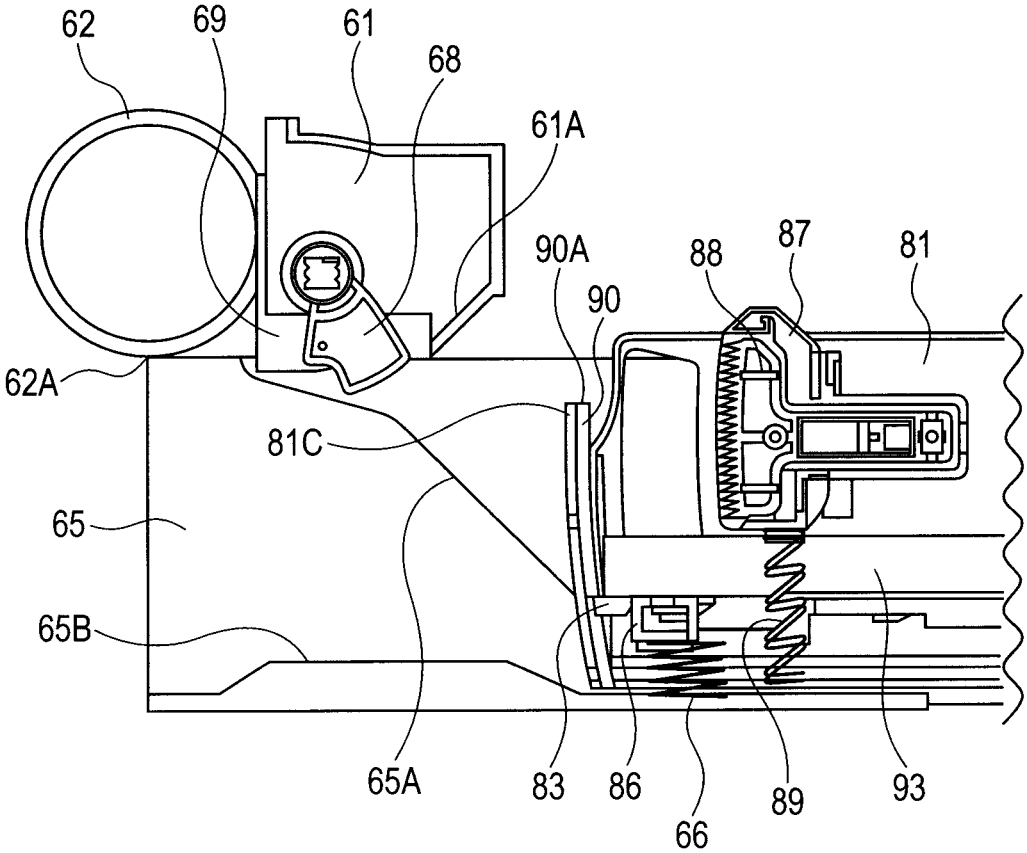
FIGS. 6A, 6B, 6C, 6D and 6E are cross-sectional views illustrating a series of operations which is performed when the cassette is attached and detached in the recording medium supply device of the first embodiment.

FIG. 6A illustrates the standby state in which the attachment of the cassette 80 to the main body 1 stands by. In the standby state, the holder 87 and the holder claw portion 88 are biased upward by the holder spring 89. Additionally, the pressure plate claw portion 86 is depressed to the standby position most separated from the feeding roller 62 by a cam face 65A provided on a side face of the guide member 65. With this depression, the pressure plate 83 is similarly depressed to the standby position. Additionally, a projection preventing member 90 which is a movement regulating member is located at an accommodating position where the upper end 90A is lower than the lower end 62A of the feeding roller 62 under its own weight.

Figure 6B:
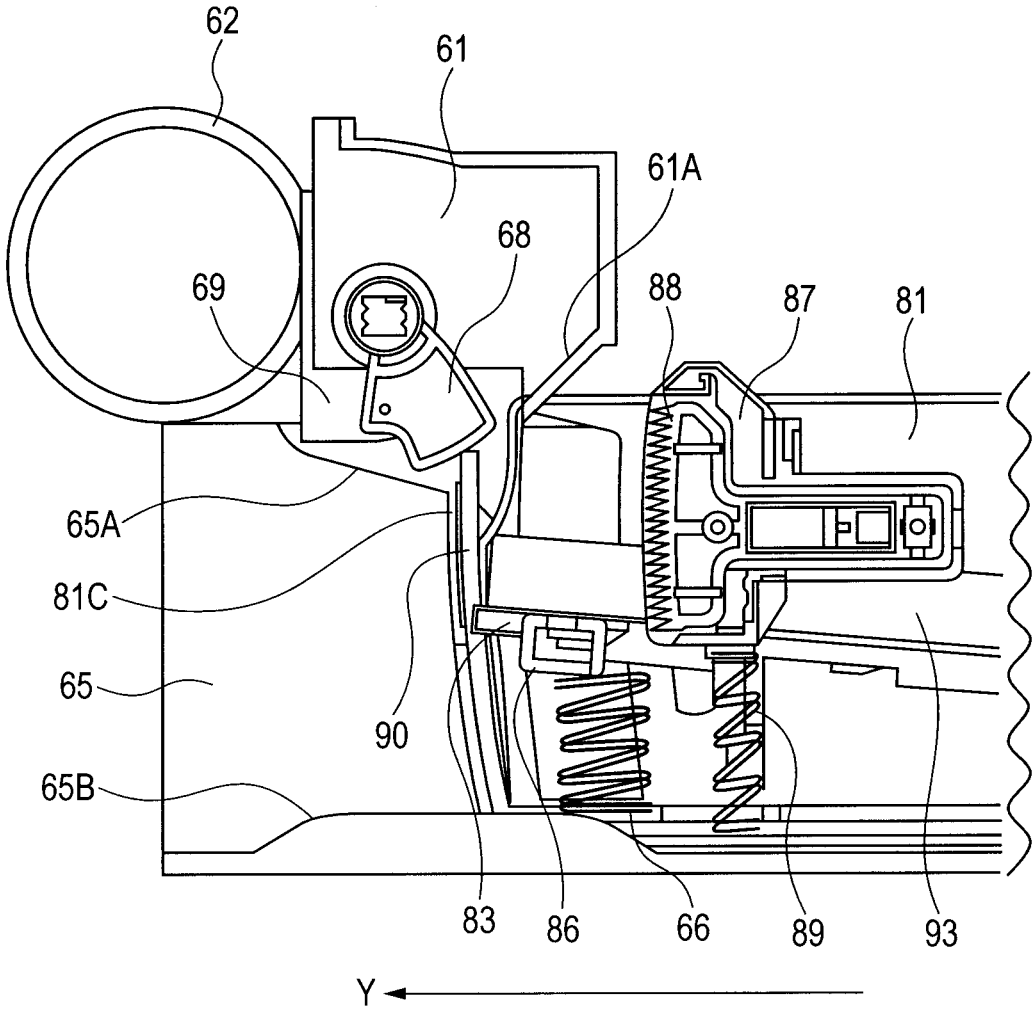

FIG. 6B illustrates a state where the attachment of the cassette 80 has further progressed from the state illustrated in FIG. 6A. In this state, the projection preventing member 90 ascends by a convex portion 65B provided on the bottom face of the guide member 65 so as to be displaced to a projecting position where the upper end 90A of the projection preventing member 90 becomes higher than the lower end 69A (refer to FIG. 3) of the regulating member 69. Additionally, the pressure plate claw portion 86 begins to ascend by being brought into sliding contact with cam face 65A of the guide member 65, and the pressure plate 83 also ascends with this ascent.

Figure 6C:
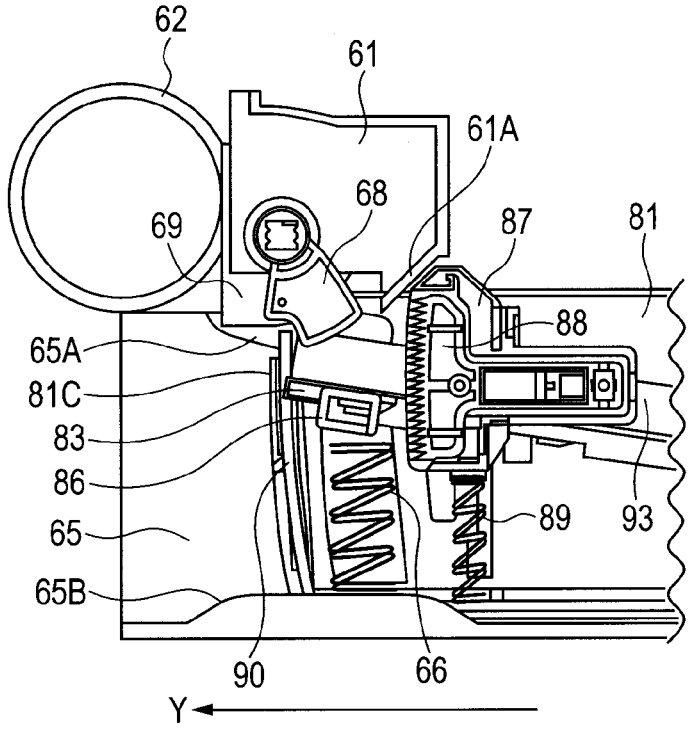

FIG. 6C illustrates a state where the attachment of the cassette 80 has further progressed from the state illustrated in FIG. 6B. In this state, the pressure plate claw portion 86 comes into sliding contact with the cam face 65A of the guide member 65, and ascends further, and the leading end of a recording medium 93 on the uppermost layer stacked on the pressure plate 83 is brought into pressure contact with the regulating member 69. Thereby, the gap between the recording medium 93 and the feeding rollers 62 when the attachment of the cassette 80 is completed is determined. At this time, the height of the leading end of the recording medium 93 on the uppermost layer rises equal to or greater than that of the tip portion 81C of the inner cassette 81. Therefore, the recording medium 93 may project out of the tip portion 81C of the inner cassette 81 in the direction the cassette 80 is mounted. However, in the present embodiment, the projection preventing member 90 holds the projecting position while having ascended by the convex portion 65B of the guide member 65. Therefore, even if the recording medium 93 is likely to project out in the mounting direction of a cassette 80 from the tip portion 81C of the inner cassette 81, the projection of the recording medium 93 is suppressed by the projection preventing member 90.

Figure 6D:
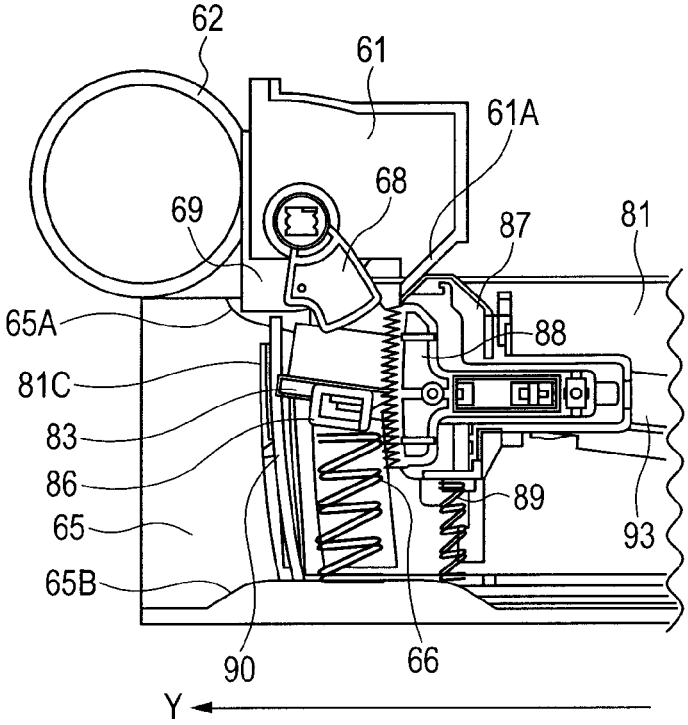

FIG. 6D illustrates a state where the attachment of the cassette 80 has further progressed from the state illustrated in FIG. 6C. In this state, the holder 87 comes into sliding contact with the cam face 61A of the support member 61, and descends. As illustrated in FIG. 6C, the cam face 61A is located forward in the direction in which the cassette 80 is removed from the main body 1 as seen from the regulating member 69, and has a shape which inclines upward with respect to the regulating member 69. With the descent of the holder 87, the holder claw portion moves in the Y direction, and subsequently descends along the groove portion 81B of the inner cassette 81. The holder claw portion 88 engages with the pressure plate claw portion 86 with the movement of the holder 87 in the Y direction, and the pressure plate claw portion 86 also descends with the descent of the holder claw portion 88. Therefore, the pressure plate 83 is depressed.

Figure 6E:
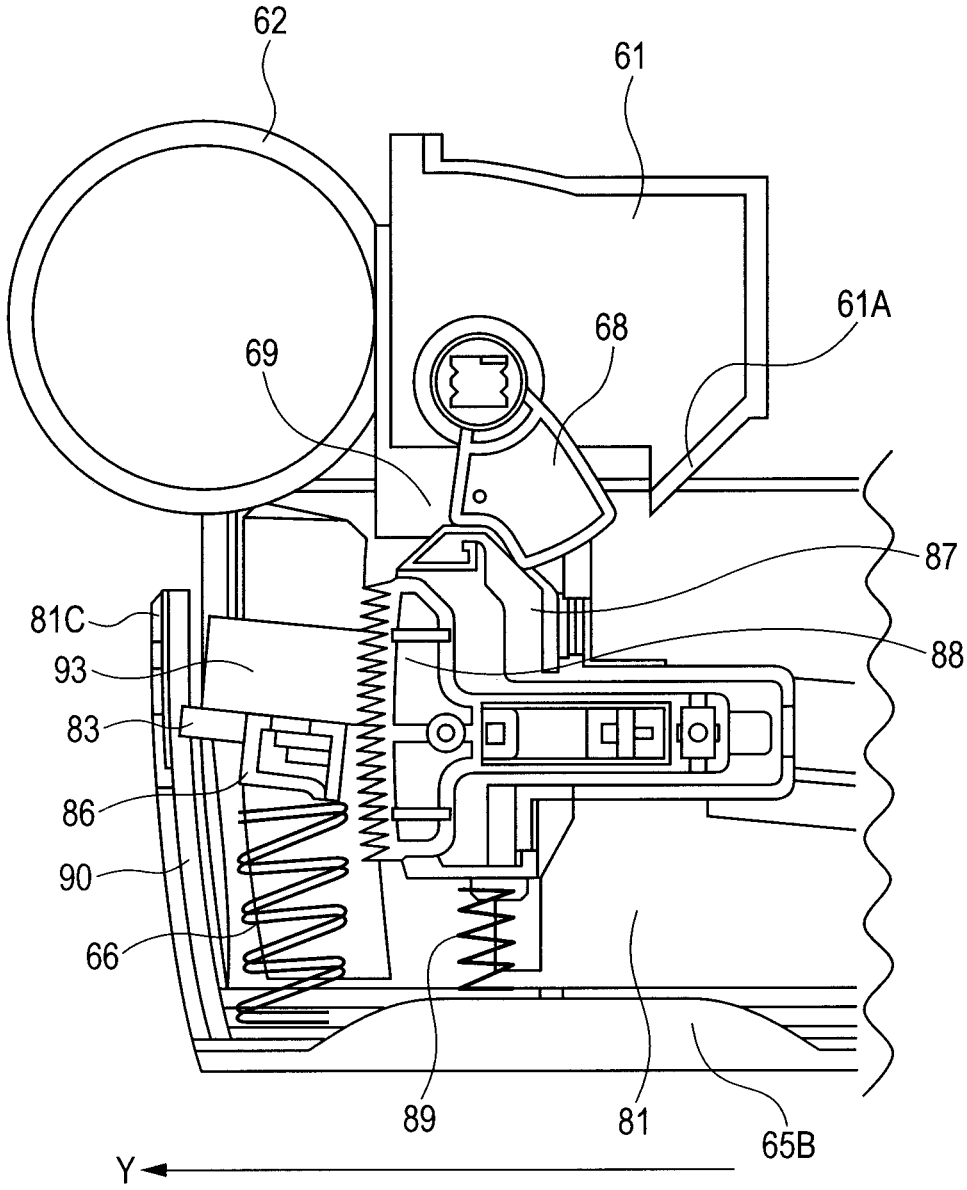

A state where the cassette 80 is moved to the mounting position of the main body 1 and the cassette 80 is completely attached to the main body 1 is illustrated in FIG. 6E. In this state, the other tip portion (not illustrated) which is different from the tip portion 81C of the inner cassette 81 abuts on the support member 61. At this time, since the cassette 80 is fixed to the main body 1 by a cassette pull-in member (not illustrated) provided at the main body 1, it is possible to perform a stable conveying operation. Additionally, at this time, the projection preventing member 90 passes through the convex portion 65B of the guide member 65, and is displaced from the projecting position to the accommodating position under its own weight. Therefore, the projection preventing member 90 does not hinder the conveying operation of the recording medium 93 by the feeding roller 62.

Next, the operation of removing the cassette 80 from the main body 1 will be described with reference to FIGS. 5 and 6A to 6E.

When the operation of pulling out the cassette 80 from the state illustrated in FIG. 6E is started, a change to the state illustrated in FIG. 6D is made. Specifically, the holder 87 begins to come into sliding contact with the cam face 61A of the support member 61 and ascend, and the holder claw portion 88 also ascends with this ascent. Since the holder claw portion 88 engages with the pressure plate claw portion 86, the pressure plate claw portion 86 and the pressure plate 83 also ascend. The projection preventing member 90 ascends to the projecting position due to the convex portion 65B of the guide member 65.

When the removal of the cassette 80 proceeds further from the state illustrated in FIG. 6D, the state illustrated in FIG. 6C is brought about. At this time, the holder 87 further ascends due to the cam face 61 of the support member 61, and the holder claw portion 88 also ascends with this ascent, and subsequently moves in the second direction (direction opposite to the Y direction) along the groove portion 81B of the inner cassette 81. With the movement of the holder claw portion 88, the pressure plate claw portion 86 and the holder claw portion 88 are disengaged from each other, and the depressed state of the pressure plate 83 is released. Since the pressure plate 83 is biased upward by the pressure plate spring 66, the pressure plate 83 ascends when the depressed state is released. As a result, the leading end of the recording medium 93 on the uppermost layer stacked on the pressure plate 83 is brought into pressure contact with the regulating member 69. At this time, the position of the leading end of the recording medium 93 on the uppermost layer becomes higher than the tip portion 81C of the inner cassette 81. When the cassette 80 is pulled out in this state, the recording medium 93 may project out of the inner cassette 81 due to the frictional force produced between the recording medium 93 and the regulating member 69. However, in the present embodiment, the projection preventing member 90 ascends due to the convex portion 65B of the guide member 65, and is displaced from the accommodating position to the projecting position. Therefore, even if the recording medium 93 tends to project out of the cassette 81, this is prevented by the projection preventing member 90. That is, it is possible to prevent the recording medium 93 from projecting out of the tip portion 81C of the inner cassette 81 using the projection preventing member 90.

When the removal of the cassette 80 proceeds further from the state illustrated in FIG. 6C, the state of FIG. 6D is brought about. In this state, the holder 87 comes out of the cam face 61A of the support member 61. Thereby, the holder 87 is biased upward by the holder spring 89, and with this biasing, the holder claw portion 88 ascends, and subsequently moves in the second direction. Additionally, the pressure plate claw portion 86 comes into sliding contact with the cam face 65A of the guide member 65, and begins to descend. When the removal of the cassette 80 proceeds further from the state illustrated in FIG. 6B, the state of FIG. 6A is brought about.

According to the above-described present embodiment, it is possible to prevent projection of a recording medium from the cassette when the cassette is attached and detached, with a simple construction which interlocks with a cassette attachment/detachment operation.

Second Embodiment

Figure 7:
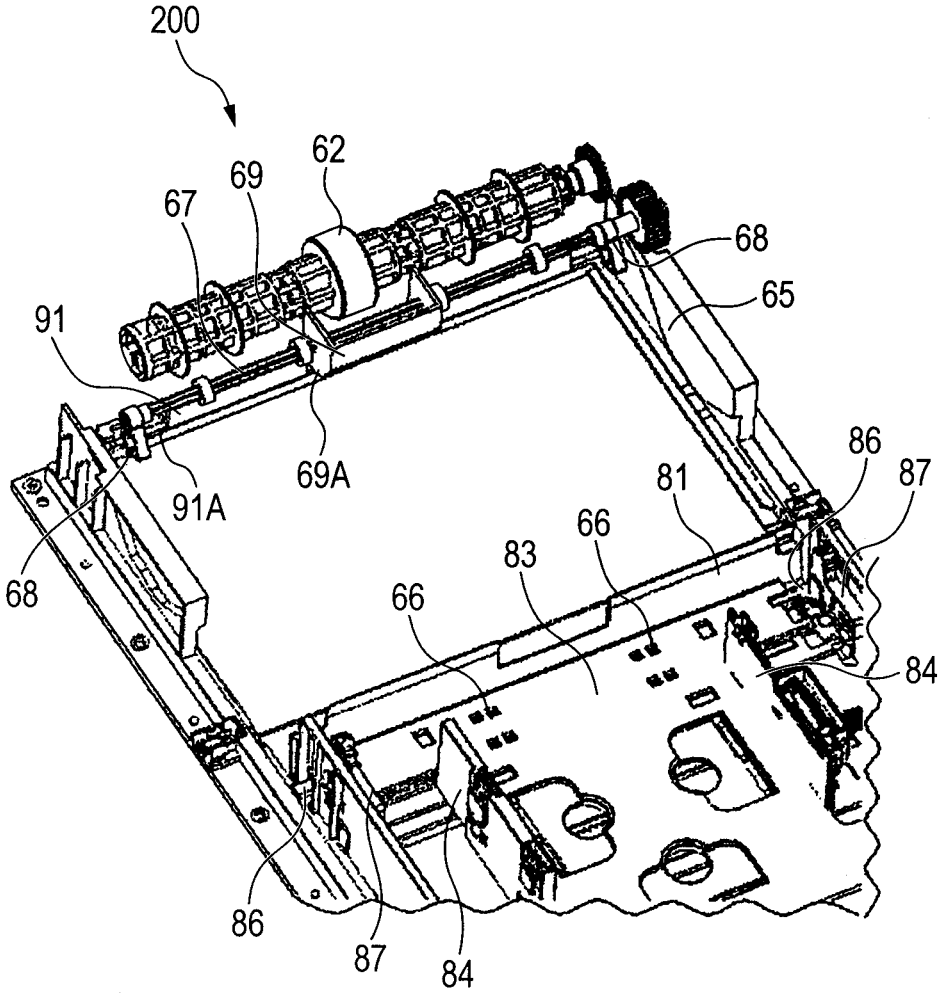
FIG. 7 is a perspective view illustrating chief parts of a recording medium supply device of a second embodiment.

FIG. 7 is a perspective view illustrating chief parts of a recording medium supply device of the present embodiment. Additionally, FIGS. 8A to 8D are cross-sectional views illustrating a series of operations which is performed when the cassette is attached to and detached from the recording medium supply device of the present embodiment. In addition, description of the same construction as the construction described in the first embodiment will be omitted. Additionally, the recording medium supply device 200 of the present embodiment is attachable to the main body 1 similarly to the recording medium supply device 100 described in the first embodiment.

First, the operation of attaching the cassette 80 to the main body 1 will be described.

Figure 8A:
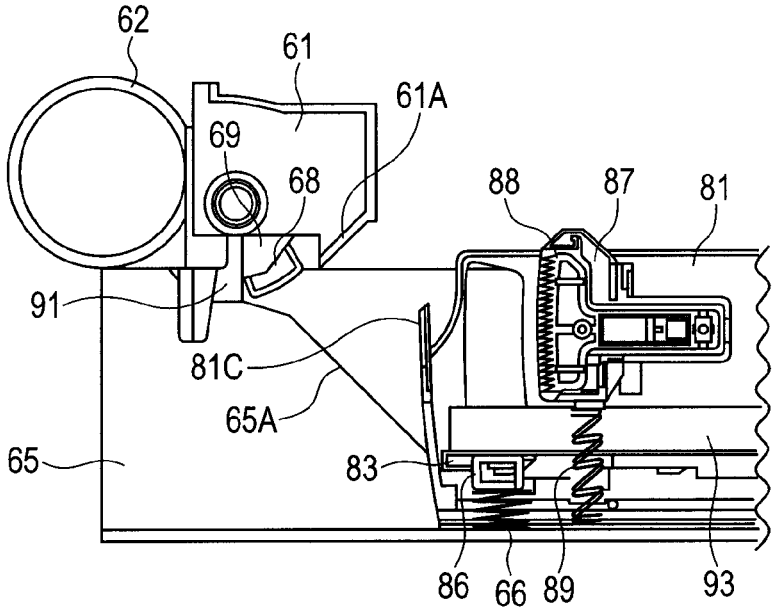
FIGS. 8A, 8B, 8C and 8D are cross-sectional views illustrating a series of operations which is performed when the cassette is attached and detached in the recording medium supply device of the second embodiment.

FIG. 8A illustrates the standby state of in which the attachment of the cassette 80 to the main body 1 stands by. In addition, in the present embodiment, as illustrated in FIG. 7, a projection preventing member 91 is rotatably attached to the shaft 67 instead of the projection preventing member 90. Additionally, in the present embodiment, the position where the position of the lower end 91A of the projection preventing member 91 becomes lower than the lower end 69A of the regulating member 69 is defined as the projecting position, and the position where the position of the lower end 91A of the projection preventing member 91 becomes higher than the lower end 62A of the feeding roller 62 is defined as the accommodating position.

As illustrated in FIG. 8A, in the standby state, the projection preventing member 91 is at the projecting position under its own weight. Additionally, in this standby state, similarly to the first embodiment, the holder 87 and the holder claw portion 88 are biased upward by the holder spring 89, the pressure plate claw portion 86 is biased downward by the cam face 65A of the guide member 65, and the pressure plate 83 is also depressed downward.

Figure 8B:
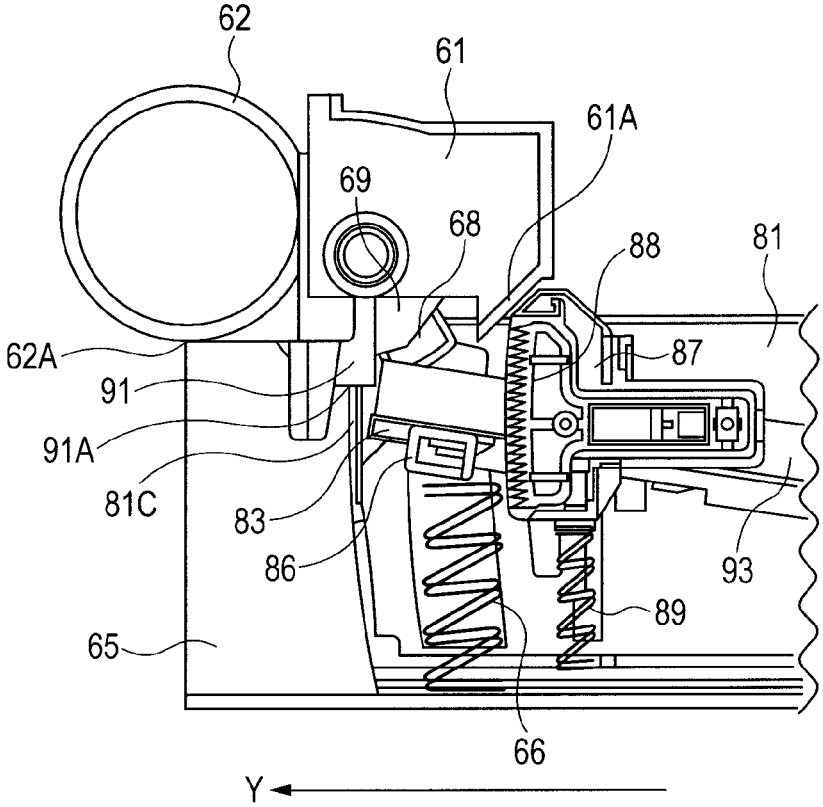

FIG. 8B illustrates a state where the attachment of the cassette 80 has further progressed from the state illustrated in FIG. 8A. In this state, the pressure plate claw portion 86 comes into sliding contact with the cam face 65A of the guide member 65, and the leading end of the recording medium on the uppermost layer among the recording media 93 stacked on the pressure plate 83 is brought into pressure contact with the regulating member 69. Thereby, the gap between the recording medium 93 and the feeding rollers 62 when the attachment of the cassette 80 is completed is determined. At this time, the height of the leading end of the recording medium on the uppermost layer rises equal to or greater than that of the tip portion 81C of the inner cassette 81. Therefore, the recording medium 93 may project out of the tip portion 81C of the inner cassette 81. However, in the present embodiment, the projection preventing member 91 holds the projecting position under its own weight. Therefore, it is possible to prevent the recording medium 93 from projecting out of the tip portion 81C of the inner cassette 81.

Figure 8C:
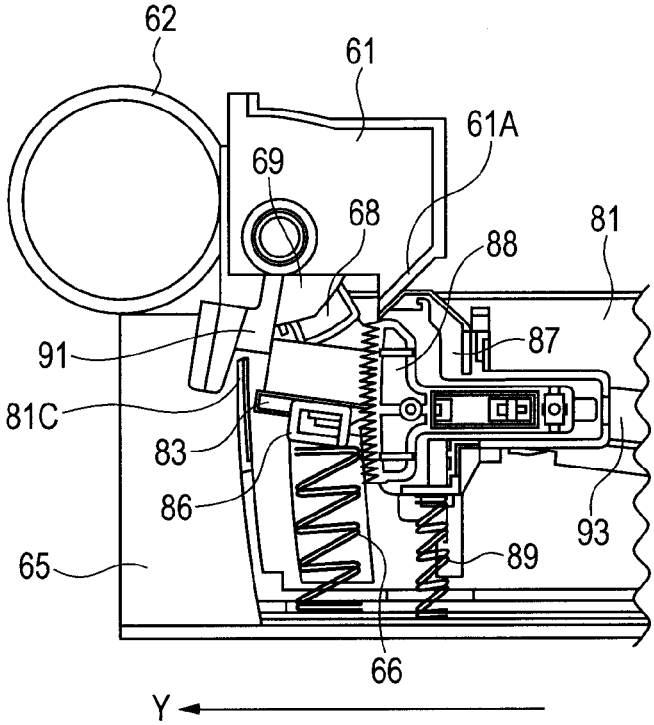

FIG. 8C illustrates a state where the attachment of the cassette 80 has further progressed from the state illustrated in FIG. 8B. In this state, the holder 87 comes into sliding contact with the cam face 61A of the support member 61, and descends. With the descent of the holder 87, the holder claw portion 88 moves in the Y direction, and thereafter descends along the groove portion 81B of the inner cassette. Since the holder claw portion 88 engages with the pressure plate claw portion 86 with the movement of the holder 87, the pressure plate claw portion 86 also descends with the descent of the holder claw portion 88, and the pressure plate 83 is depressed. The projection preventing member 91 begins to rotationally move from the projecting position to the accommodating position, by being pushed by the leading end of the recording medium 93.

Figure 8D:
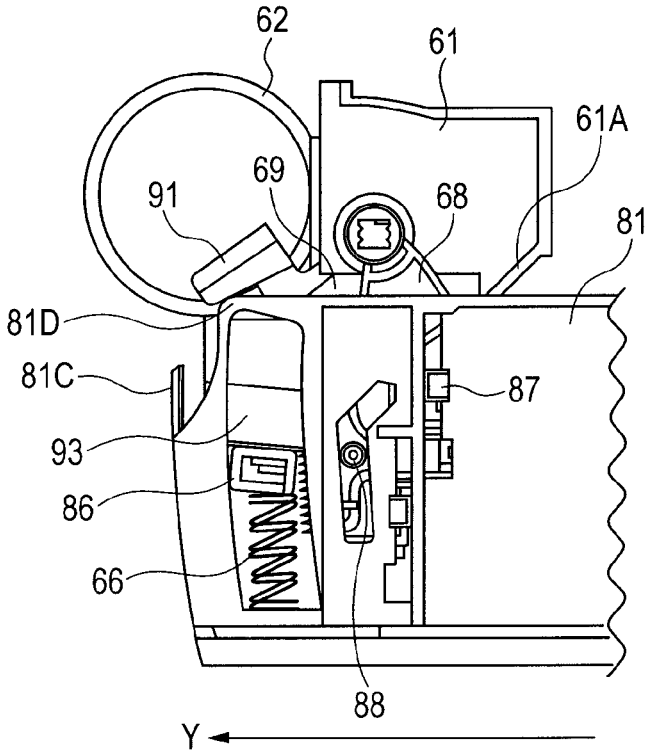

FIG. 8D illustrates a state where the cassette 80 has been completely attached to the main body 1. In this state, since the cassette 80 is fixed to the main body 1 similarly to the first embodiment, it is possible to perform a stable conveying operation. Additionally, at this time, the projection preventing member 91 is held at the accommodating position by a tip portion 81D of the inner cassette 81. Therefore, the projection preventing member 91 does not hinder the conveying operation of the feeding roller 62.

Next, the operation of removing the cassette 80 from the main body 1 will be described with reference to FIGS. 8A to 8D.

When the operation of pulling out the cassette 80 from the state illustrated in FIG. 8D is started, a change to the state illustrated in FIG. 8C is made. Specifically, the holder 87 begins to come into sliding contact with the cam face 61A of the support member 61 and ascend, and the holder claw portion 88 also ascends with this ascent. Since the holder claw portion 88 engages with the pressure plate claw portion 86, the pressure plate claw portion 86 and the pressure plate 83 also ascend. Since the tip portion 81D of the inner cassette 81 is separated from the projection preventing member 91 with the movement of the cassette 80, the projection preventing member 91 rotationally moves from the accommodating position to the projecting position. That is, the projection preventing member 91 is displaced to a position where the recording medium 93 is prevented from projecting out of the tip portion 81C of the inner cassette 81.

When the removal of the cassette 80 proceeds further from the state illustrated in FIG. 8C, the state illustrated in FIG. 8B is brought about. At this time, the holder 87 ascends along the cam face 61A of the support member 61, and the holder claw portion 88 also ascends with this ascent, and thereafter moves in the second direction along the groove portion 81B of the inner cassette 81. With the movement of the holder claw portion 88, the pressure plate claw portion 86 and the holder claw portion 88 are disengaged from each other, and the depressed state of the pressure plate 83 is released. Since the pressure plate 83 is biased upward by the pressure plate spring 66, the pressure plate 83 ascends when the depressed state is released. As a result, the leading end of the recording medium 93 on the uppermost layer stacked on the pressure plate 83 is brought into pressure contact with the regulating member 69. At this time, the position of the leading end of the recording medium on the uppermost layer becomes higher than the tip portion 81C of the inner cassette 81. When the cassette 80 is pulled out in this state, the recording medium 93 may project out of the inner cassette 81 due to the frictional force produced between the recording medium 93 and the regulating member 69. However, in the present embodiment, the projection preventing member 91 is displaced to the projecting position from the accommodating position with the movement of the cassette 80. Therefore, it is possible to prevent the recording medium 93 from projecting out of the tip portion 81C of the inner cassette 81.

When the removal of the cassette 80 proceeds further from the state illustrated in FIG. 8B, the state of FIG. 8A is brought about.

According to the above-described present embodiment, it is possible to prevent projection of a recording medium from the cassette when the cassette is attached and detached, with a simple construction which interlocks with a cassette attachment/detachment operation. Moreover, in the present embodiment, as the projection preventing member 91 is not provided in the cassette 80, it is possible to save space in the cassette 80.

Third Embodiment

Figure 9:
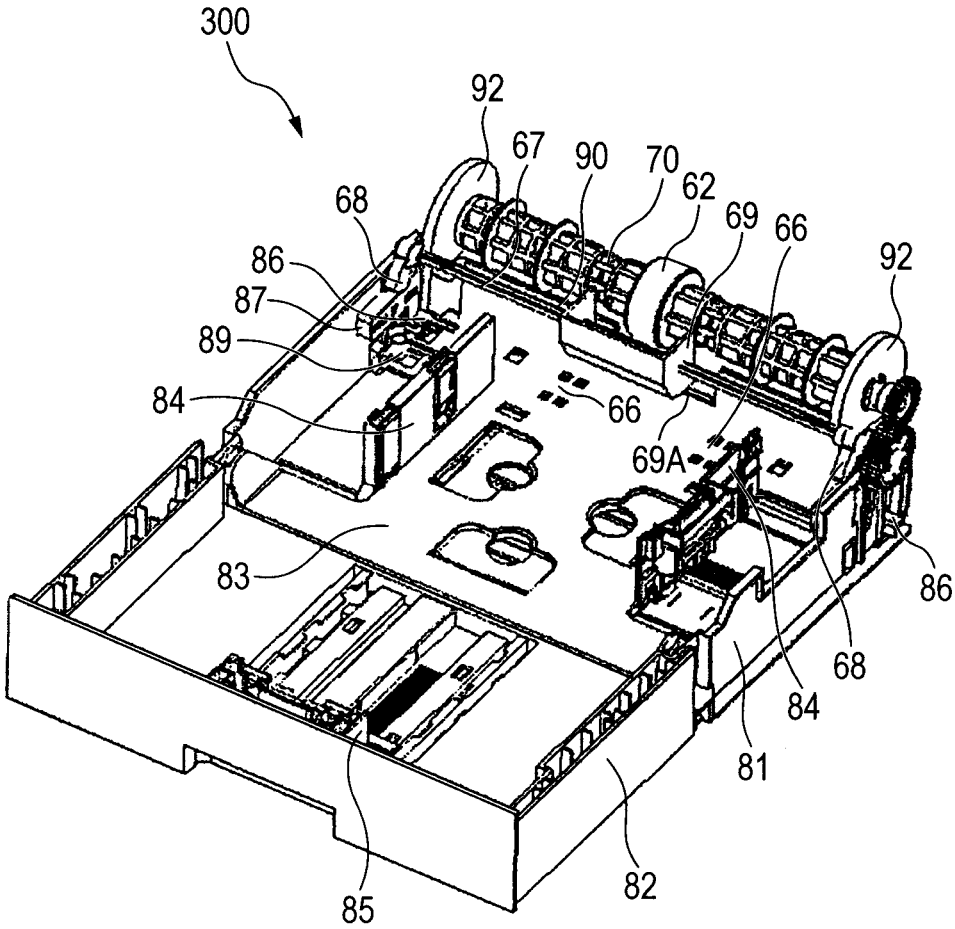
FIG. 9 is a perspective view illustrating chief parts of a recording medium supply device of a third embodiment.
Figure 10A:
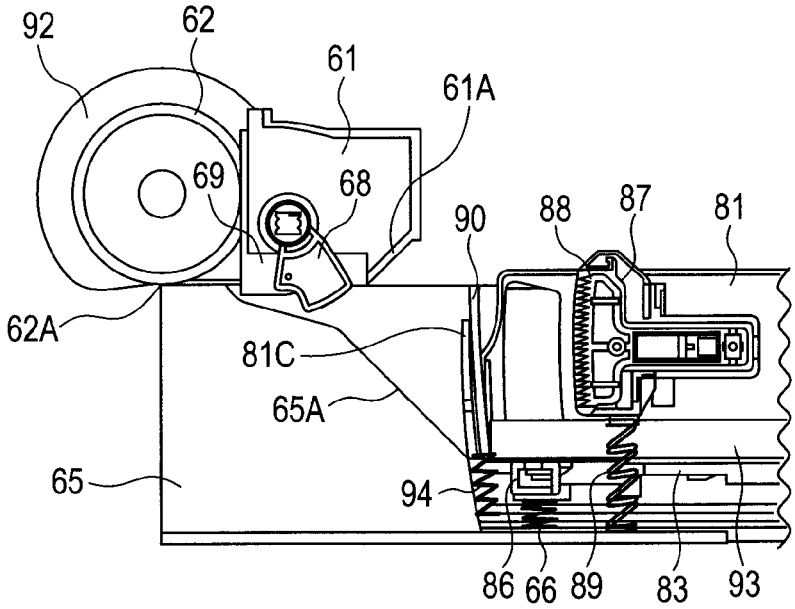
FIGS. 10A, 10B and 10C are cross-sectional views illustrating a series of operations which is performed when the cassette is attached and detached and when a recording medium is conveyed in the recording medium supply device of the third embodiment.
Figure 10B:
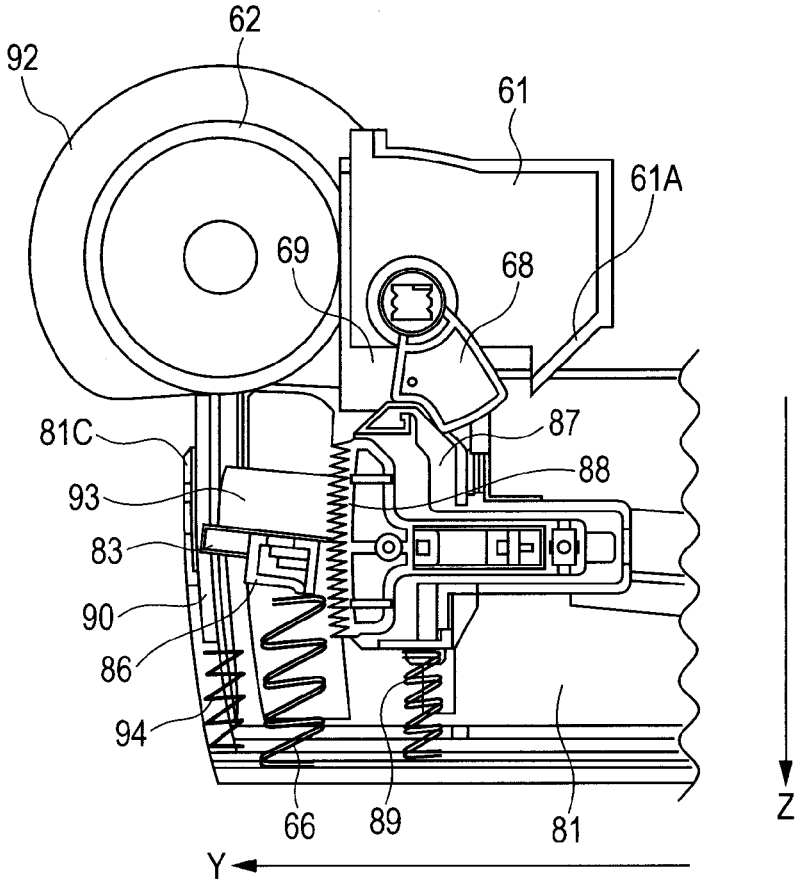
Figure 10C:
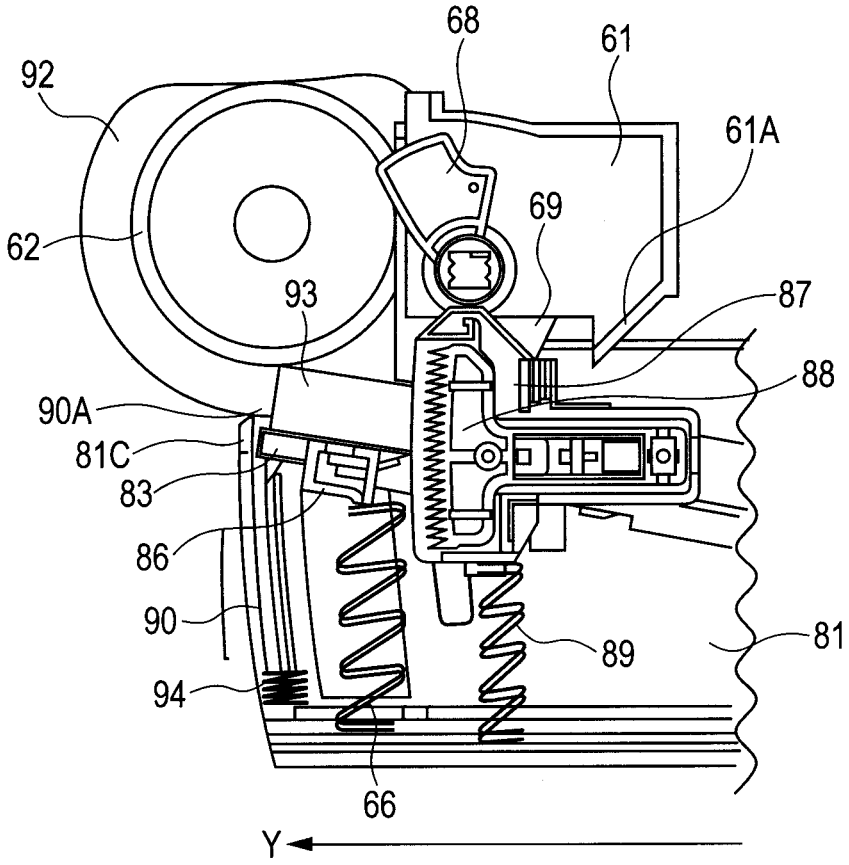

FIG. 9 is a perspective view illustrating chief parts of a recording medium supply device of the present embodiment. Additionally, FIGS. 10A to 10C are cross-sectional views illustrating a series of operations which is performed when the cassette is attached and detached and when a recording medium is conveyed, in the recording medium supply device of the present embodiment. In addition, description of the same construction as the construction described in the first embodiment will be omitted. Additionally, the recording medium supply device 300 of the present embodiment is attachable to the main body 1 similarly to the recording medium supply device 100 described in the first embodiment.

First, the operation of attaching the cassette 80 to the main body 1 will be described.

FIG. 10A illustrates the standby state of in which the attachment of the cassette 80 to the main body 1 stands by. In addition, a spring 94 is attached to the lower end of the projection preventing member 90 in the present embodiment. The spring 94 biases the projection preventing member 90 to the projecting position described in the first embodiment.

As illustrated in FIG. 10A, in the standby state, similarly to the first embodiment, the holder 87 and the holder claw portion 88 are biased upward by the holder spring 89, the pressure plate claw portion 86 is biased downward by the cam face 65A of the guide member 65, and the pressure plate 83 is also depressed downward. Additionally, since the projection preventing member 90 is biased to the projecting position by the spring 94, it is possible to prevent the recording medium 93 from projecting out of the tip portion 81C of the inner cassette 81 by the projection preventing member 90 during the movement of the cassette 80.

FIG. 10B illustrates the standby state of in which complete attachment of the cassette 80 to the main body 1 of the apparatus and the conveying operation by the feeding roller 62 stands by. In the standby state, as the holder 87 descends in the Z direction by the sheet feeding cam 68, the holder claw portion 88 moves in the Y direction and engages with the pressure plate claw portion 86. Thereafter, the pressure plate 83 is depressed with the descent of the holder claw portion 88, and the recording medium 93 stacked on the pressure plate 83, and the feeding roller 62 are separated from each other. Additionally, the projection preventing member 91 is biased by a projection preventing member spring 94, and is at the projecting position illustrated in FIG. 10A.

FIG. 10C illustrates the state during the conveying operation. When the sheet feeding cam 68 rotates on the basis of a sheet feeding signal indicating the start of conveyance, the sheet feeding cam 68 and the holder 87 are brought into non-contact with each other. Then, since the holder 87 is biased upward by the holder spring 89, the holder 87 ascends. With the ascent of the holder 87, the holder claw portion 88 moves in the second direction. With the movement of the holder claw portion 88, the pressure plate claw portion 86 and the holder claw portion 88 are disengaged from each other, and the depressed state of the pressure plate 83 is released. Since the pressure plate 83 is biased upward by the pressure plate spring 66, the pressure plate 83 ascends when the depressed state is released. Also, the leading end of the recording medium 93 on the uppermost layer stacked on the pressure plate 83 is brought into pressure contact with the feeding roller 62. As the feeding roller 62 rotates in this state, the recording medium is conveyed to the main body 1. In the present embodiment, as illustrated in FIG. 9, cam members 92, which are second cam members which rotate with the rotation of the feeding roller 62, are attached to both ends of a rotating shaft 70. Also, the projection preventing member 90 is pushed into the accommodating position by each cam member 92 as the cam member 92 rotates with the rotation of the feeding roller 62. Thereby, the projection preventing member 90 is displaced to a position where the projection preventing member does not hinder the conveying operation.

Figure 11:
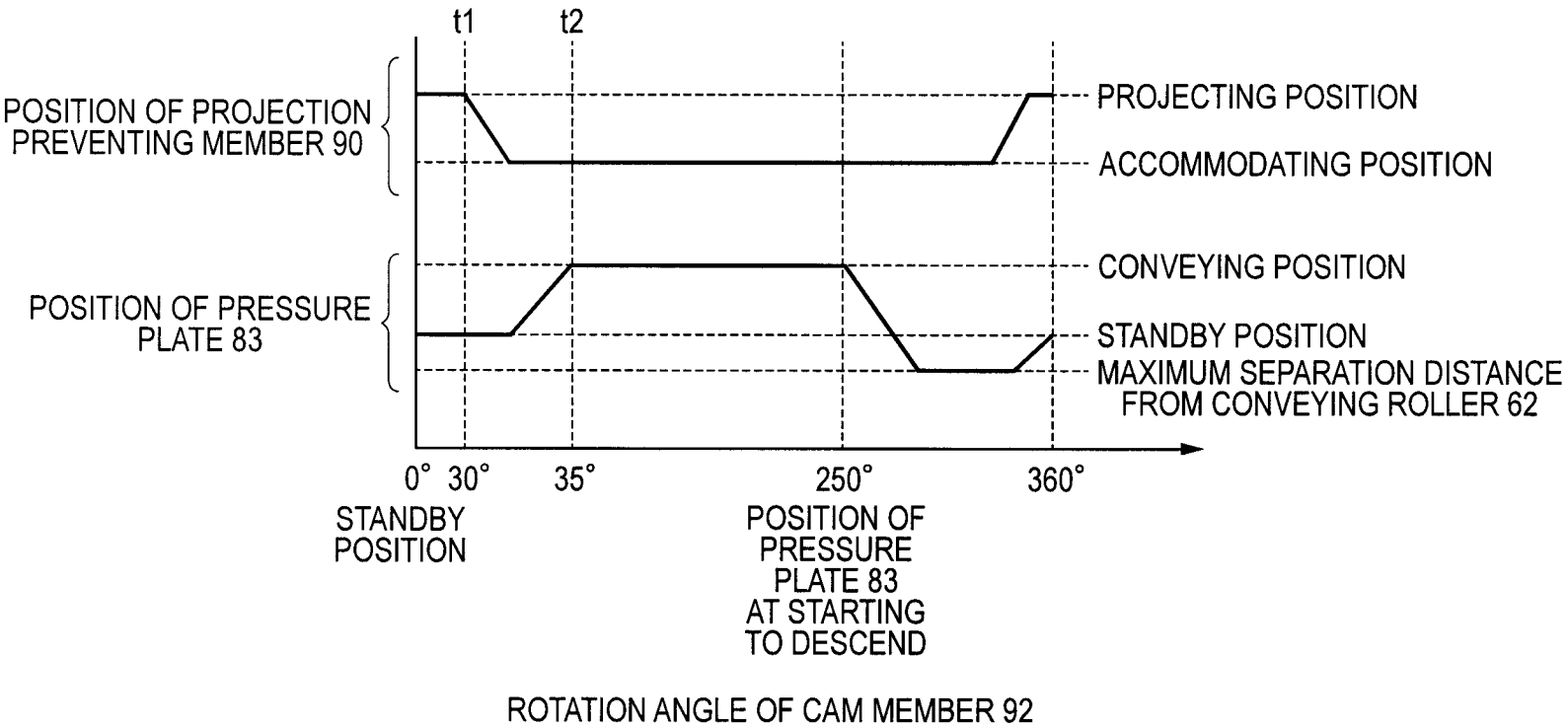
FIG. 11 is a timing chart of the conveying operation of the recording medium supply device of the third embodiment.

FIG. 11 is a timing chart of the conveying operation of the recording medium supply device of the present embodiment. As illustrated in FIG. 11, the timing t1 with which the projection preventing member 90 beings to be displaced from the projecting position to the accommodating position becomes earlier than the timing t2 when the pressure plate 83 has ascended from the standby position to a conveyance position, i.e., with which the conveyance of the recording medium 93 is started.

After the conveying operation, the processing returns to the state illustrated in FIG. 10B, and the projection preventing member 90 is displaced from the accommodating position to the projecting position. Then, when the cassette 80 is removed (pulled out), the state illustrated in FIG. 10A is brought about. Since the projection preventing member 90 is at the projecting position during the removal of the cassette 80, it is possible to prevent the recording medium 93 from projecting out of the tip portion 81C of the inner cassette 81.

According to the above-described present embodiment, it is possible to displace the projection preventing member 90 in conjunction with the conveying operation, thereby preventing projection of a recording medium from the cassette when the cassette is attached and detached. Moreover, in the present embodiment, since the operation of the projection preventing member 90 is interlocked with the conveying operation, it is possible to simplify an attaching/detaching mechanism of the cassette 80.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-285160, filed Dec. 16, 2009, which is hereby incorporated by reference herein in its entirety.

What is claimed is:

1. A sheet supply device comprising:

a cassette configured to stack sheets thereon, the cassette being detachably attached to the device;

a roller configured to feed the stacked sheets one by one, the fed sheet moving over a front wall of the cassette; and a member capable of rising to prevent the stacked sheet from moving beyond the front wall, while detaching the cassette from the sheet supply device, wherein when the member rises, an upper end of the member is located higher than a tip end of the front wall.

2. The sheet supply device according to claim 1, wherein the cassette has an urging mechanism to urge the stacked sheet so that an uppermost sheet of the stacked sheets is located higher than the front wall and the member rises up higher than the uppermost sheet.

3. The sheet supply device according to claim 1, farther comprising a guide mechanism configured to guide the cassette when attaching and detaching the cassette, wherein the member rises up and then moves down while attaching or detaching the cassette the device by the guide mechanism.

4. The sheet supply device according to claim 3, wherein the guide mechanism includes a cam to move the member.

5. The sheet supply device according to claim 1, wherein the member is biased to be risen up by a spring and a driving mechanism of the roller lets the member down against a biasing force of the spring.

6. The sheet supply device according to claim 5, wherein the driving mechanism includes a cam to move the member, the cam rotates with the feeding roller.

7. A printing apparatus comprising;

a printing unit configured to print an image on a sheet;

a cassette configured to stack sheets thereon, the cassette being detachably attached to the device;

a roller configured to feed the stacked sheets one by one, the fed sheet moves over a front wall of the cassette toward the printing unit; and a member capable of rising to prevent the stacked sheet from moving beyond the front wall, while detaching the cassette from the sheet supply device, wherein when the member rises, an upper end of the member is located higher than a tip end of the front wall.

8. The sheet supply device according to claim 1, wherein the member does not rise up when the roller feeds the stacked sheets.

9. A printing apparatus comprising;

a printing unit configured to print an image on a sheet;

a cassette configured to stack sheets thereon, the cassette being detachably attached to the printing apparatus;

a roller configured to feed the stacked sheets one by one, the fed sheet moving over a front wall of the cassette toward the printing unit; and a member capable of rising to prevent the stacked sheet from moving beyond the front wall, while detaching the cassette from the printing apparatus, wherein when the member rises, a highest portion of the member is located higher than a highest portion of the front wall.

10. The sheet supply device according to claim 7, wherein the member does not rise up when the roller feeds the stacked sheets.

11. A sheet supply device comprising;

a printing unit configured to print an image on a sheet;

a cassette configured to stack sheets thereon, the cassette being detachably attached to the sheet supplying device;

a roller configured to feed the stacked sheets one by one, the fed sheet moving over a front wall of the cassette toward the printing unit; and a member capable of rising to prevent the stacked sheet from moving beyond the front wall, while detaching the cassette from the sheet supplying device, wherein when the member rises, a highest portion of the member is located higher than a highest portion of the front wall.

12. A sheet supply device comprising:

a cassette configured to stack sheets thereon, the cassette being detachably attached to the sheet supply device;

a roller configured to feed the stacked sheets one by one, the fed sheet moving over a front wall of the cassette; and a rising unit configured to raise a member while detaching the cassette from the sheet supply device, wherein when the rising unit raises the member, an upper end of the member is located higher than a tip end of the front wall.

13. The sheet supply device according to claim 12, further comprising a mechanism configured to raise the stacked sheet so that an uppermost sheet of the stacked sheets is located higher than tip end of the front wall.

14. The sheet supply device according to claim 13, wherein the mechanism raises the stacked sheet while detaching the cassette from the sheet supply device.

15. The sheet supply device according to claim 14, wherein when the mechanism raises the stacked sheet, the risen member prevents the stacked sheet from moving beyond the front wall.

16. The sheet supply device according to claim 14, wherein when the mechanism raises the stacked sheet, the upper end of the risen member is located higher than the uppermost sheet of the stacked sheets.

17. A sheet supply device comprising:

a cassette configured to stack sheets thereon, the cassette being detachably attached to the sheet supply device;

a roller configured to feed the stacked sheets one by one, the fed sheet moving over a front wall of the cassette; and a rising unit configured to raise a member while detaching the cassette from the sheet supply device, wherein when the rising unit raises the member, a highest portion of the member is located higher than a highest portion of the front wall.

18. The sheet supply device according to claim 17, further comprising a mechanism configured to raise the stacked sheets so that an uppermost sheet of the stacked sheets is located higher than tip end of the front wall.

19. The sheet supply device according to claim 18, wherein the mechanism raises the stacked sheet while detaching the cassette from the sheet supply device.

20. The sheet supply device according to claim 19, wherein when the mechanism raises the stacked sheet, the risen member prevents the stacked sheet from moving beyond the front wall.

21. The sheet supply device according to claim 19, wherein when the mechanism raises the stacked sheet, the highest portion of the risen member is located higher than the uppermost sheet of the stacked sheets.

* * * * *